US009315053B2

(12) United States Patent
Hamakawa et al.

(10) Patent No.: US 9,315,053 B2
(45) Date of Patent: Apr. 19, 2016

(54) MEDIA CONVEYANCE DEVICE AND PRINTING DEVICE

(75) Inventors: Hiroshi Hamakawa, Suwa (JP); Tetsugo Ishida, Owa (JP)

(73) Assignee: SEIKO EPSON CORPORATION, Tokyo (JP)

( * ) Notice: Subject to any disclaimer, the term of this patent is extended or adjusted under 35 U.S.C. 154(b) by 168 days.

(21) Appl. No.: 13/584,264

(22) Filed: Aug. 13, 2012

(65) Prior Publication Data

US 2013/0169725 A1 Jul. 4, 2013

(30) Foreign Application Priority Data

Aug. 11, 2011 (JP) ..... 2011-175650

(51) Int. Cl.
*B41J 2/01* (2006.01)
*B41J 13/02* (2006.01)
*B41J 15/04* (2006.01)

(52) U.S. Cl.
CPC ..... *B41J 13/02* (2013.01); *B41J 13/025* (2013.01); *B41J 15/04* (2013.01)

(58) Field of Classification Search
None
See application file for complete search history.

(56) References Cited

U.S. PATENT DOCUMENTS

| | | | | | |
|---|---|---|---|---|---|
| 2,825,281 | A | * | 3/1958 | Heywood | 101/287 |
| 3,763,520 | A | * | 10/1973 | Izawa et al. | 226/1 |
| 4,049,256 | A | * | 9/1977 | Church et al. | 271/9.01 |
| 4,266,762 | A | * | 5/1981 | Kramer et al. | 271/225 |
| 4,432,541 | A | * | 2/1984 | Clark et al. | 271/251 |
| 4,621,801 | A | * | 11/1986 | Sanchez | 271/251 |
| 4,809,968 | A | * | 3/1989 | Malachowski | 271/251 |
| 4,930,766 | A | * | 6/1990 | Garavuso | 271/220 |
| 4,982,946 | A | * | 1/1991 | Uchimura et al. | 271/251 |
| 5,004,222 | A | * | 4/1991 | Dobashi | 271/225 |
| 5,074,450 | A | * | 12/1991 | Lindner et al. | 226/21 |
| 5,394,222 | A | * | 2/1995 | Genovese | 399/167 |
| 5,657,983 | A | * | 8/1997 | Fisk | 271/251 |
| 5,687,965 | A | * | 11/1997 | Matsuda et al. | 271/241 |
| 5,697,608 | A | * | 12/1997 | Castelli et al. | 271/228 |
| 6,053,494 | A | * | 4/2000 | Baskette et al. | 271/251 |
| 6,131,900 | A | * | 10/2000 | Hou | 271/184 |
| 6,273,418 | B1 | * | 8/2001 | Fujikura et al. | 271/228 |
| 7,441,772 | B2 | * | 10/2008 | Kawashima et al. | 271/251 |
| 7,537,211 | B2 | | 5/2009 | Furihata et al. | |
| 8,382,104 | B2 | * | 2/2013 | Yasumoto | 271/251 |
| 8,585,047 | B2 | * | 11/2013 | Sato et al. | 271/234 |
| 2001/0014235 | A1 | * | 8/2001 | Ando et al. | 399/395 |

(Continued)

FOREIGN PATENT DOCUMENTS

| | | | | |
|---|---|---|---|---|
| JP | 49-52594 | U | | 5/1974 |
| JP | 61018652 | A | * | 1/1986 |

(Continued)

*Primary Examiner* — Erica Lin
*Assistant Examiner* — Leonard S Liang
(74) *Attorney, Agent, or Firm* — Hauptman Ham, LLP

(57) ABSTRACT

A printing device has a guide roller that guides a print medium in a conveyance direction; an intersect roller pair that holds the print medium guided by the guide roller between a first roller that rotates on an axis of rotation in the conveyance direction of the print medium and a second roller that rotates on an axis of rotation that intersects the axis of rotation of the first roller; a conveyance roller pair that conveys the print medium held by the intersect roller pair in the conveyance direction by a conveyance drive roller driven by a drive means and a conveyance follower roller that rotates with the conveyance drive roller; and a print unit that prints on the print medium conveyed by the conveyance roller pair.

16 Claims, 5 Drawing Sheets

(56) References Cited

U.S. PATENT DOCUMENTS

| | | | | |
|---|---|---|---|---|
| 2002/0079643 | A1* | 6/2002 | Barrand | 271/225 |
| 2006/0214363 | A1* | 9/2006 | Kawashima et al. | 271/226 |
| 2007/0235920 | A1* | 10/2007 | Kawashima et al. | 271/228 |
| 2007/0280763 | A1* | 12/2007 | Suzuki | 399/394 |
| 2009/0091075 | A1* | 4/2009 | Yasumoto | 271/250 |
| 2009/0224465 | A1* | 9/2009 | Kawaguchi | 271/227 |
| 2010/0102504 | A1* | 4/2010 | Yasumoto | 271/251 |
| 2010/0164164 | A1* | 7/2010 | Kondo et al. | 271/3.24 |
| 2010/0327518 | A1* | 12/2010 | Tharayil | 271/227 |
| 2012/0025457 | A1* | 2/2012 | Inoue | 271/227 |
| 2012/0112406 | A1* | 5/2012 | Matsumoto | 271/234 |
| 2012/0228819 | A1* | 9/2012 | Chien-Kuo | 271/110 |

FOREIGN PATENT DOCUMENTS

| | | | | |
|---|---|---|---|---|
| JP | 02028447 | A | * | 1/1990 |
| JP | 4-317944 | A | | 11/1992 |
| JP | 05162899 | A | | 6/1993 |
| JP | 06166451 | A | * | 6/1994 |
| JP | 09235049 | A | * | 9/1997 |
| JP | 2002265089 | A | | 9/2002 |
| JP | 2005-104712 | A | | 4/2005 |
| JP | 2005350268 | A | | 12/2005 |
| JP | 2006-89171 | A | | 4/2006 |
| JP | 2006-248732 | A | | 9/2006 |
| JP | 2007084227 | A | | 5/2007 |
| JP | 2007320693 | A | | 12/2007 |

* cited by examiner

MEDIA CONVEYANCE DEVICE AND PRINTING DEVICE

BACKGROUND

1. Technical Field

The present invention relates to a media conveyance device and to a printing device.

2. Related Art

Conveyance roller pairs used to convey paper as the recording medium to the recording unit in a recording device typically include a conveyance drive roller that is driven by a drive motor, and a conveyance follower roller that follows the rotation of the conveyance drive roller. In order for the conveyance roller pair to convey the paper to the recording unit straight, the rotational axes of the conveyance drive roller and follower roller are disposed perpendicularly to the conveyance direction as described in Japanese Unexamined Patent Appl. Pub. JP-A-2002-265089.

The paper may also become skewed to the conveyance direction while being conveyed. There are various reasons for this, including frictional resistance from the edge of the conveyed paper sliding against part of the conveyance path, and conveyance starting with the paper skewed to the paper feed unit. To correct this problem of the paper being fed skewed to the conveyance direction, Japanese Unexamined Patent Appl. Pub. JP-A-2007-84227 teaches a method of providing a rocking mechanism to the stationary part of the conveyance follower roller of the conveyance roller pair so that the rotational axis of the follower roller can be slanted relative to the rotational axis of the conveyance drive roller, and applying pressure to the paper in the opposite direction as the direction in which the paper is skewed to the conveyance direction to correct paper skew while conveying the paper to the recording unit.

However, if roll paper is used as the print medium and paper skew produced near the paper feed unit is corrected by providing a conveyance roller pair directly before the recording unit as described in JP-A-2007-84227, the paper may buckle and curve between the paper feed unit and the conveyance roller pair, and the paper may be wrinkled when supplied to the recording unit.

SUMMARY

A conveyance device and a printing device having the conveyance device according to the present invention correct paper skew between the paper feed unit and the conveyance roller pair, and convey the print medium to the recording unit (print unit) in the desired conveyance direction with little skew even when roll paper is used as the print medium.

To solve at least one of the problems described above, the present invention can be achieved as described below.

A printing device according to one aspect of the invention includes a guide roller that guides a print medium in a conveyance direction; an intersect roller pair that holds the print medium guided by the guide roller between a first roller that rotates on an axis of rotation in the conveyance direction of the print medium and a second roller that rotates on an axis of rotation that intersects the axis of rotation of the first roller; a conveyance roller pair that conveys the print medium held by the intersect roller pair in the conveyance direction by a conveyance drive roller driven by a drive mechanism and a conveyance follower roller that rotates with the conveyance drive roller; and a print unit that prints on the print medium conveyed by the conveyance roller pair.

Preferably, the printing device also has a guide that guides one edge of the print medium in the conveyance direction.

Further preferably, the conveyance roller pair is disposed substantially in a center of the print medium width perpendicular to the conveyance direction; and the intersect roller pair is disposed on a side of the opposite edge of the print medium as the one edge in the conveyance direction.

Sliding friction in the conveyance direction is produced in this aspect of the invention between the print medium held by the intersect roller pair and the second roller. The friction force produced in the opposite direction as the conveyance direction by this sliding friction becomes a rotational moment applied to the print medium in the direction of the center of the print medium at the part where the print medium is held by the conveyance roller pair as the point of application, and urges the one edge of the print medium to the guide. The print medium is thus corrected and held in the desired conveyance direction by the print medium being urged in contact with the guide.

The quality of images recorded on the print medium can also be maintained with high reliability because the print medium can be conveyed in the desired conveyance direction to the recording means by means of a simple set of intersect rollers having two follower rollers disposed with intersecting axes of rotation.

Another aspect of the invention preferably also has a second intersect roller pair that holds the print medium held by the intersect roller pair between a third roller that rotates on an axis of rotation in the conveyance direction of the print medium and a fourth roller that rotates on an axis of rotation that intersects an axis of rotation of the third roller.

By disposing the cylindrical surfaces of the first roller and second roller crosswise to each other and holding the print medium therebetween, variation in the area holding the print medium can be reduced and the print medium can be conveyed consistently even if there is some deviation in the relative positions of the first roller and second roller due to manufacturing differences.

Yet further preferably, the part of the first roller that contacts the print medium is polyacetal, and the part of the second roller that contacts the print medium is stainless steel.

Because the first roller that rotates in the conveyance direction of the print medium urges the print medium in a direction crosswise to the conveyance direction causing an edge of the print medium to contact the guide, reliably pushing the print medium against the guide may not be possible if the frictional resistance with the print medium is great. By making the first roller from polyacetal (POM: polyoxymethylene), the frictional resistance of the surface that contacts the print medium can be reduced, and a low cost first roller that is easy to mold and has sufficient strength for use as a structural member can be achieved.

The second roller is also disposed with the axis of rotation intersecting the conveyance direction of the print medium, and the print medium slides against the second roller. Because the coefficient of friction can be reduced by making the second roller from stainless steel, the print medium slides easily. A second roller that is worn very little by the sliding print medium and is resistant to corrosion can therefore be achieved.

A printing device according to another aspect of the invention preferably also has a pressure mechanism that pushes the print medium to the guide.

By urging the print medium with an urging means in addition to urging the print medium to the guide with the intersect roller pair, this aspect of the invention can reliably convey the print medium in the desired conveyance direction to the recording means.

Another aspect of the invention is a conveyance device for a printing device including an intersect roller pair that holds a conveyed print medium between a first roller that rotates on an axis of rotation in the conveyance direction of the print medium and a second roller that rotates on an axis of rotation that intersects the axis of rotation of the first roller; and a conveyance roller pair that conveys the print medium held by the intersect roller pair in the conveyance direction by a conveyance drive roller driven by a drive mechanism and a conveyance follower roller that rotates with the conveyance drive roller.

Preferably, the conveyance device also has a guide that guides one edge of the print medium in the conveyance direction.

Further preferably, the conveyance roller pair is disposed substantially in a center of the print medium width perpendicular to the conveyance direction; and the intersect roller pair is disposed on a side of the opposite edge of the print medium as the one edge in the conveyance direction.

By conveying the print medium in the desired conveyance direction to the recording means, this aspect of the invention enables recording images with high print quality because the recording position of the recorded images on the print medium can be accurately controlled.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of the present invention are described below with reference to the accompanying figures.

Embodiment 1

Figure 1:
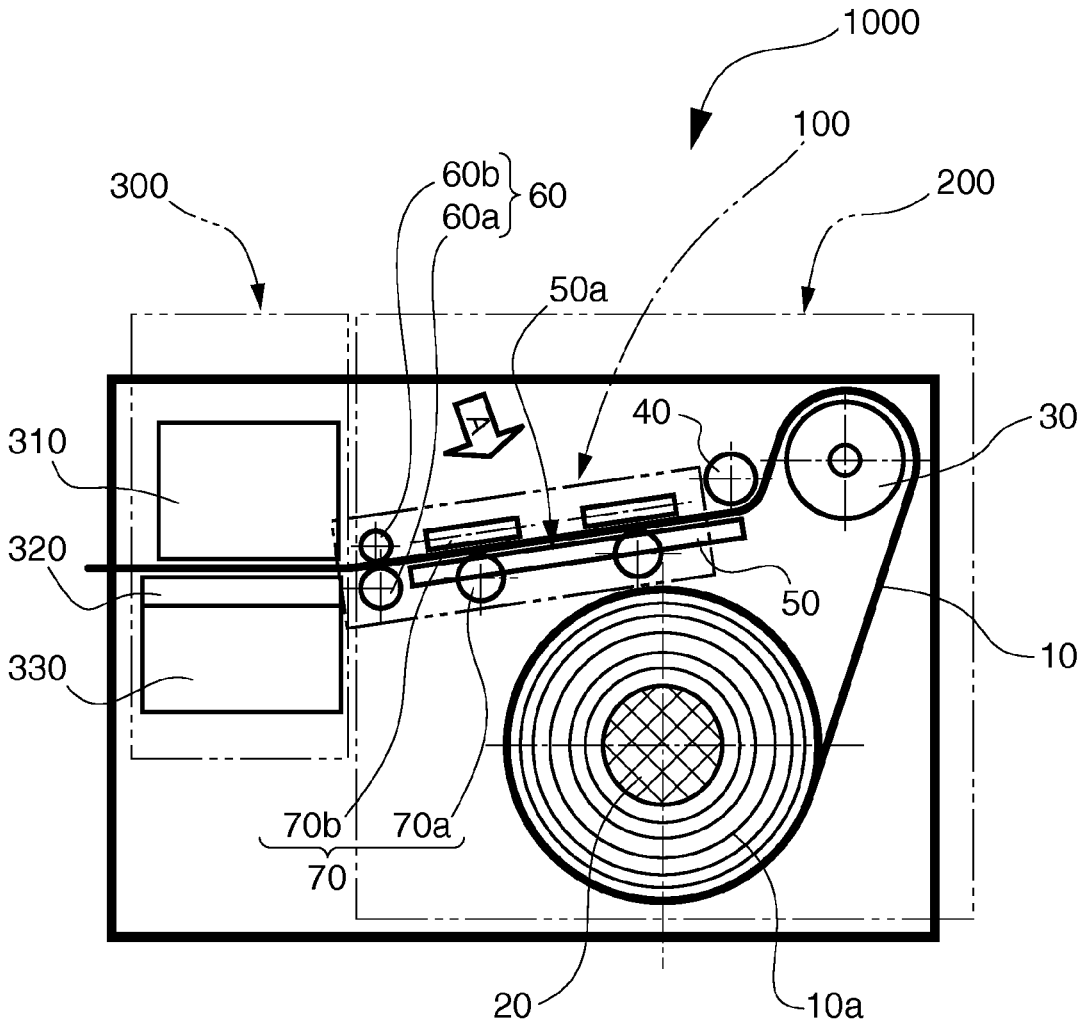
FIG. 1 is a section view showing the configuration of a printing device according to a first embodiment of the invention.

FIG. 1 is a section view showing the configuration of a printing device having a conveyance unit according to a preferred embodiment of the invention. As shown in FIG. 1, the printing device 1000 according to this embodiment has a paper feed unit 200 that stores and supplies recording paper 10 as the print medium to the recording means, and a print unit 300 as a recording means that records specific images to the supplied recording paper 10. The print unit 300 includes a recording unit 310 with an inkjet head, for example, disposed to the recording surface side of the recording paper 10, and a suction mechanism 330 and recording paper suction unit 320 that apply suction to the opposite side of the recording paper 10 as the recording surface to hold the recording paper 10 for recording.

The recording paper 10 is delivered from roll paper 10*a* stored in a roll in the paper feed unit 200. The roll paper 10*a* is installed to a roll paper drive shaft 20 that is disposed rotatably to the printing device 1000. The recording paper 10 delivered from the roll paper 10*a* is conveyed passed the paper feed roller 30 and guide roller 40 to the conveyance unit 100 described as an example of the conveyance device of the invention.

The conveyance unit 100 includes a recording paper support unit 50, conveyance roller pair 60, and a plurality of intersect rollers 70. The recording paper support unit 50 has a recording paper support surface 50*a* over which the recording paper 10 slides. The conveyance roller pair 60 is located on the print unit 300 side of the recording paper support unit 50. The intersect rollers 70 are disposed in the area of the recording paper support unit 50 between the conveyance roller pair 60 and guide roller 40.

The conveyance roller pair 60 includes a conveyance drive roller 60*a* that is rotationally driven by a drive means not shown, and a conveyance follower roller 60*b* that follows rotation of the conveyance drive roller 60*a*. The recording paper 10 is held between the conveyance drive roller 60*a* and follower roller 60*b*.

The intersect rollers 70 include a first roller 70*a* that follows the conveyance direction of the recording paper 10, and a second roller 70*b* with an axis of rotation that intersects the axis of rotation of the first roller 70*a*, and the recording paper 10 is held between the first roller 70*a* and second roller 70*b*. The intersect rollers 70 in this embodiment of the invention are configured with the axis of rotation of the second roller 70*b* substantially perpendicular to the axis of rotation of the first roller 70*a*. As described below, the angle of intersection between the rotational axes of the first roller 70*a* and second roller 70*b* is not specifically limited, but is preferably perpendicular as described in this embodiment.

Figure 2A:
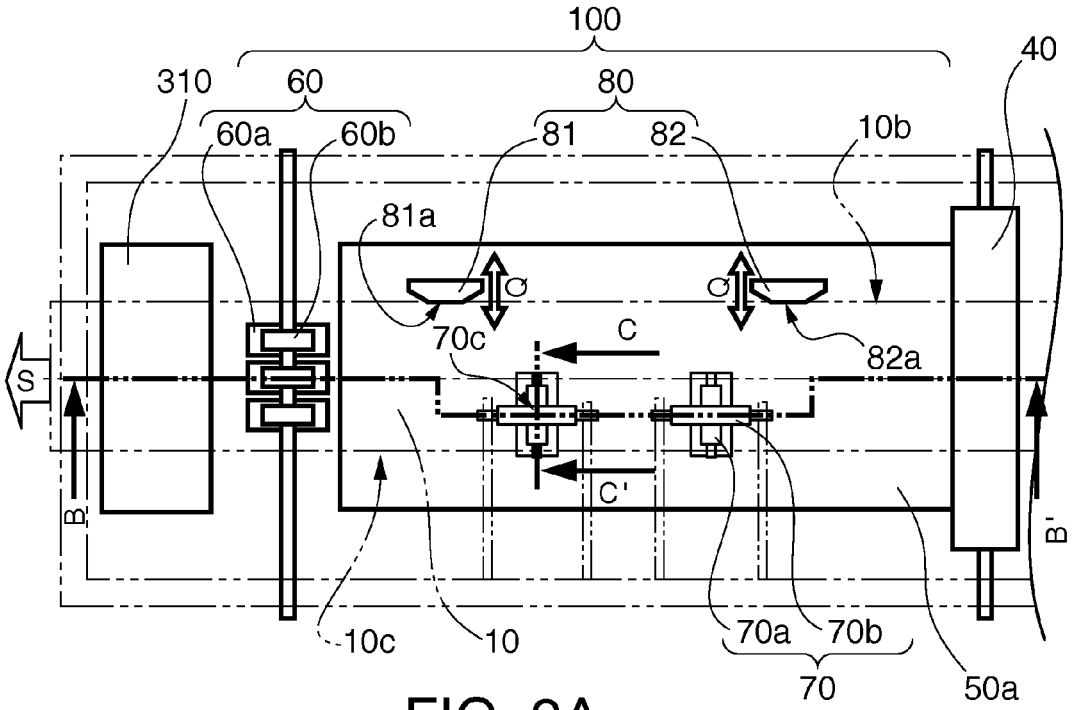
FIG. 2A shows the conveyance unit of the printing device according to the first embodiment of the invention from the direction of arrow A in FIG. 1.
Figure 2B:
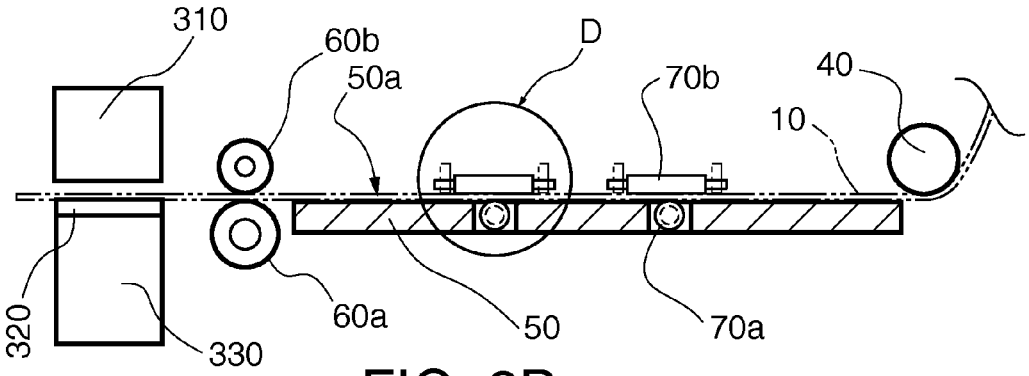
FIG. 2B is a section view through B-B' in FIG. 2A.
Figure 2C:
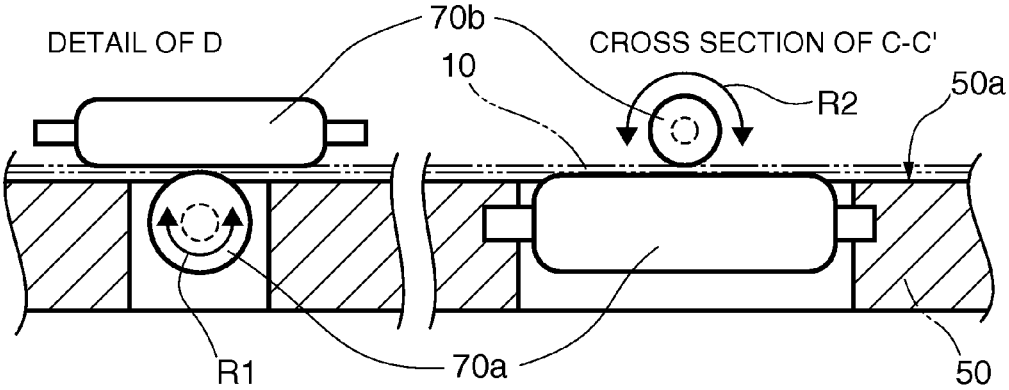
FIG. 2C is an enlarged view of part D in FIG. 2B and an enlarged section view through C-C' in FIG. 2A.

FIG. 2 shows the conveyance unit 100 in detail, FIG. 2A showing the conveyance unit from the direction of arrow A in FIG. 1, and FIG. 2B being a section view through B-B' in FIG. 2A. FIG. 2C is an enlarged view of part D in FIG. 2B and an enlarged section view through C-C' in FIG. 2A. As shown in FIG. 2A, a guide 80 is disposed to the recording paper support unit 50 of the conveyance unit 100. This guide 80 has a first stop 81 and a second stop 82 that stop the edge 10*b* of one side of the recording paper 10 relative to the width of the conveyance direction S. The guide 80 can be moved in direction Q, which is the direction across the width of the recording paper 10, by a moving means not shown, and the center of the width of the recording paper 10 can be aligned with the center of the print area of the print unit 300 by setting this one edge 10*b* of the recording paper 10 against the face 81*a* of the first stop 81 and the face 82*a* of the second stop 82.

The conveyance roller pair 60 holds the center part of the width of the recording paper 10 between the conveyance drive roller 60*a* and follower roller 60*b*, and conveys the recording paper 10 in the conveyance direction S. The intersect rollers 70 including the first roller 70*a* and second roller 70*b* are disposed so that the position 70*c* where the first roller 70*a* and second roller 70*b* intersect, that is, the position where the recording paper 10 is held by the intersect rollers 70, is between the location of the conveyance roller pair 60 and the location of the guide roller 40. The position 70*c* where the first roller 70*a* and second roller 70*b* intersect is also offset from the center of the recording paper 10 width to the side of the edge 10*c* on the opposite side as the one edge 10*b* that is stopped by the guide 80.

As shown in FIG. 2B and FIG. 2C, the intersect rollers 70 hold the recording paper 10 between the first roller 70*a* and second roller 70*b*. The first roller 70*a* is disposed to rotate in direction of rotation R1 and follow the movement of the recording paper 10 in the conveyance direction S of the recording paper 10. The second roller 70*b* is disposed to rotate freely in direction of rotation R2, which is substantially perpendicular to the direction of rotation in the conveyance direction S of the recording paper 10, that is, the direction of rotation R1 of the first roller 70*a*.

The first roller 70*a* is disposed to rotate in the conveyance direction S of the recording paper 10, and the conveyance unit 100 according to this embodiment of the invention urges the recording paper 10 to move in a direction crosswise to the conveyance direction, that is, toward the guide 80 as described below. However, if the frictional resistance between the first roller 70*a* and recording paper 10 is great, the recording paper 10 may not be reliably urged toward the guide 80. A material with low friction resistance is therefore preferably used on the surface of the first roller 70*a* that contacts the recording paper 10. Low-cost polyacetal (POM: polyoxymethylene), which is easy to mold and provides structural strength, can be desirably used as a material for the first roller 70*a*.

Because the second roller 70*b* is disposed with the axis of rotation aligned with the conveyance direction S of the recording paper 10 and rotates freely in direction of rotation R2 substantially perpendicular to the conveyance direction S of the recording paper 10, the recording paper 10 is conveyed while sliding against the second roller 70*b*. The surface of the second roller 70*b* is therefore preferably made from a material with a low coefficient of friction to the recording paper 10 so that the recording paper 10 can slide easily in the conveyance direction S. A fluorocarbon polymer or metal an be used, but stainless steel with excellent wear resistance, corrosion resistance, and strength is particularly preferable.

Note, further, that there are two sets of intersect rollers 70 in this embodiment of the invention, but the invention is not so limited and one or three or more sets could be used depending upon the size of the recording paper 10 and the size of the recording paper support unit 50.

The intersect rollers 70 of the conveyance unit 100 according to this embodiment of the invention are composed of cylindrical first and second rollers, but the invention is not so limited and any rollers that can hold the recording paper 10 therebetween can be used. However, because sliding friction occurs between the second roller 70*b* and recording paper 10 as described below, the contact area between the second roller and the recording paper 10 is preferably narrow. More specifically, the area in which the recording paper 10 is held between the first roller 70*a* and second roller 70*b* is preferably as narrow as possible. As a result, by disposing the first roller 70*a* and second roller 70*b* so that the cylindrical surfaces thereof cross each other, variation in the recording paper 10 holding area can be reduced and the recording paper 10 can be conveyed consistently even if there is some deviation in the relative positions of the first roller 70*a* and second roller 70*b* due to manufacturing differences.

As described above, the recording paper 10 is fed by the paper feed roller 30 (FIG. 1) and is conveyed passed the guide roller 40 while sliding over the recording paper support surface 50*a* of the recording paper support unit 50. The recording paper 10 is also held by the intersect rollers 70, held by the conveyance roller pair 60, and conveyed to the recording unit 310 of the print unit 300. The operation of the conveyance unit 100 while conveying the recording medium in the printing device 1000 according to this embodiment of the invention is described next with reference to FIG. 3.

Figure 3A:
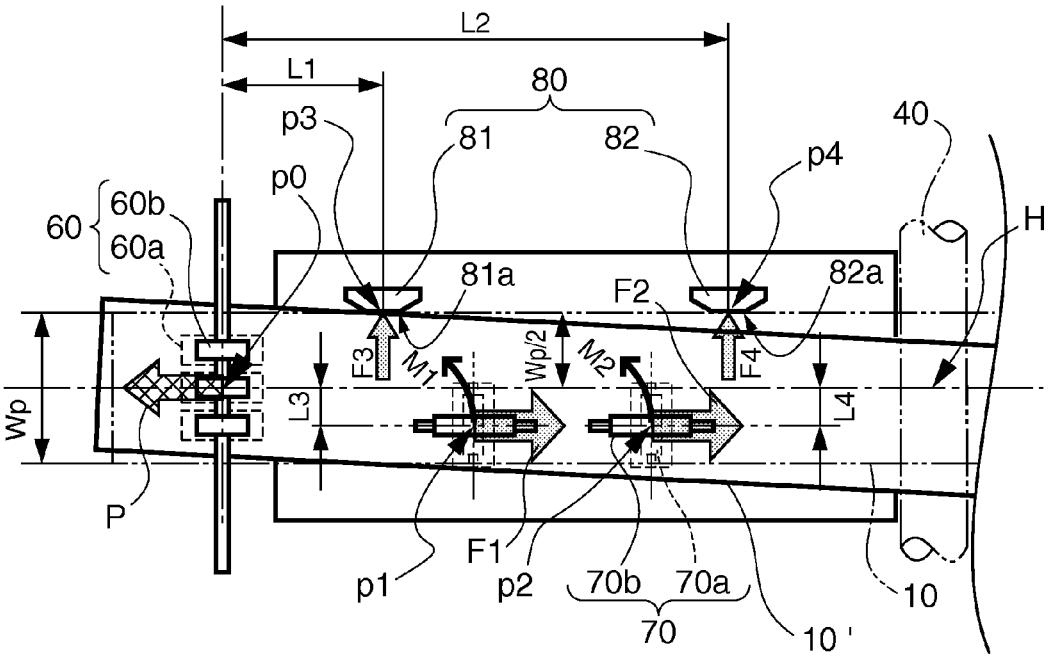
FIG. 3 describes the concept of controlling recording paper in the conveyance unit of the printing device according to the first embodiment of the invention.
Figure 3B:
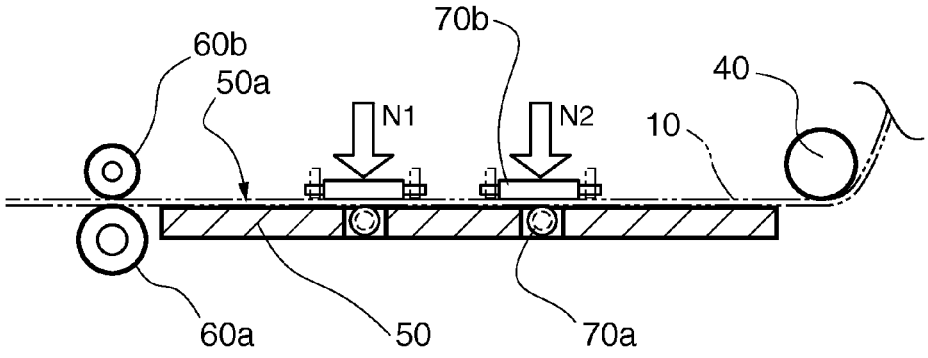

FIG. 3A and FIG. 3B further describe the operation of the conveyance unit 100 shown in FIG. 2A and FIG. 2B. The operation whereby skewing of recording paper 10' that is fed skewed to the desired conveyance direction of the recording paper 10 shown in FIG. 3A is corrected is described below.

As shown in FIG. 3A, the conveyance roller pair 60 is disposed so that the conveyance force P is applied to substantially the center of the width of the recording paper 10 conveyed in the desired conveyance direction. As a result of this configuration, the conveyance force P is applied to substantially the center of the recording paper 10 width, and the recording paper 10 is conveyed toward the print unit 300. If the recording paper 10 is not conveyed in the desired normal conveyance direction, such as when the recording paper 10 becomes skewed and is conveyed from the guide roller 40 as indicated by recording paper 10' in the figure, recording (printing) to the desired position will not be possible. The conveyance unit 100 according to this embodiment of the invention therefore works as described below to correct the skewed recording paper 10' to the desired conveyance direction.

The point of application of the conveyance force P applied by the conveyance roller pair 60 to the recording paper 10' is application point p0. As described above, this application point p0 is positioned substantially on the center line of the recording paper 10 width.

The distances between holding points p1 and p2 where the intersect rollers 70 hold the recording paper 10' to the line H extending in the conveyance direction through application point p0 are distances L3 and L4.

The distance between the application point p0 and the center p3 of the face 81*a* of the first stop 81 near application point p0 is L1; and the distance between the application point p0 and the center p4 of the face 82*a* of the second stop 82 farther from the application point p0 is L2.

Pressure N1, N2 is applied at holding points p1 and p2 where the intersect rollers 70 hold the recording paper 10', and μ is the coefficient of friction between the recording paper 10' and the second roller 70*b* that rotates in the conveyance direction of the recording paper 10.

As shown in FIG. 3A, the recording paper 10' conveyed by the conveyance roller pair 60 is held between the intersect rollers 70 and moves while sliding along the second roller 70*b*. More specifically, friction forces F1, F2 between the second rollers 70*b* and recording paper 10' are applied to the recording paper 10' in the opposite direction as the conveyance direction. Moments M1 and M2 rotating the recording paper 10' around the application point p0 are produced by means of friction forces F1, F2. Moments M1 and M2 are expressed by the following equations.

$$M1=F1\times L3$$

$$M2=F2\times L4 \quad (1)$$

Because friction forces F1, F2 are the forces of friction between the second rollers and the recording paper 10', they can be expressed as $$F1=N1\times\mu$$

$$F2=N2\times\mu \quad (2)$$

and equations (1) can be rewritten as follow.

$$M1=N1\times\mu\times L3$$

$$M2=N2\times\mu\times L4 \quad (3)$$

Moments M1, M2 cause the recording paper 10' to rotate toward the guide 80 and contact faces 81*a* and 82*a*. More specifically, the recording paper 10' is urged to the guide 80 so that one edge of the recording paper 10' contacts the guide 80, the recording paper 10' is thereby pushed into the desired conveyance direction, and is conveyed in the direction indicated by recording paper 10 in the figure. The relationship between the contact forces F3, F4 against the faces 81*a* and 82*a*, and moments M1 and M2 is shown in equation (4).

$$M1+M2=F3\times L1+F4\times L2 \quad (4)$$

If N1=N2=Nx, and L3=L4=Lx, $$2\times Nx\times\mu\times Lx=F3\times L1+F4\times L2 \quad (5)$$

can be derived from equations (3) and (4).

The recording paper 10' has a critical load at which force applied along the recording surface to the edge of the recording paper 10' will cause the edge to buckle and bend, and this critical load is referred to as the bending limit herein. If the bending limit of the recording paper 10' is F0, contact forces F3, F4 must be less than the bending limit F0, and the relationship shown in equation (6) must be satisfied based on equation (5).

$$2\times Nx\times\mu\times Lx(F0\times L1+F0\times L2)=F0(L1+L2) \quad (6)$$

The relationship shown in equation (6) is therefore used to optimize the pressure Nx of the second roller 70*b* of the intersect roller 70, the coefficient of friction μ determined by selecting the material used for the second rollers 70*b*, and the locations Lx of the holding points p1 and p2 of the intersect rollers 70. The positions L1, L2 of the faces 81*a*, 82*a* of the guides 80 are preferably set to large values based on equation (6), and the difference between L2 and L1 is preferably as great as possible considering the ease of keeping the recording paper 10 correctly aligned with the conveyance direction, and the possibility of the recording paper 10 becoming skewed between the conveyance roller pair 60 and the first stop 81 (in length L1) if L1 is large.

As described above, the conveyance unit 100 according to this embodiment of the invention conveys the recording paper 10 to the print unit 300 with the conveyance roller pair 60 while holding the recording paper 10 between intersect rollers 70 disposed with their axes of rotation crossed. If the recording paper 10 is fed from the paper feed roller 30 and guide roller 40 skewed to the conveyance direction, a moment of rotation centered on the conveyance roller pair 60 is applied to the recording paper 10 by the intersect rollers 70, and the recording paper 10 can be easily corrected to the desired conveyance direction. Because the intersect rollers 70 can be rendered with a simple construction in which both the first roller 70*a* and second roller 70*b* are followers, both device reliability and durability can be improved.

While this embodiment has two sets of intersect rollers, the invention is not limited to using two sets, and one or three or more sets can be used if their placement can be designed so that the conveyance direction of the recording paper 10' can be corrected.

Embodiment 2

Figure 4A:
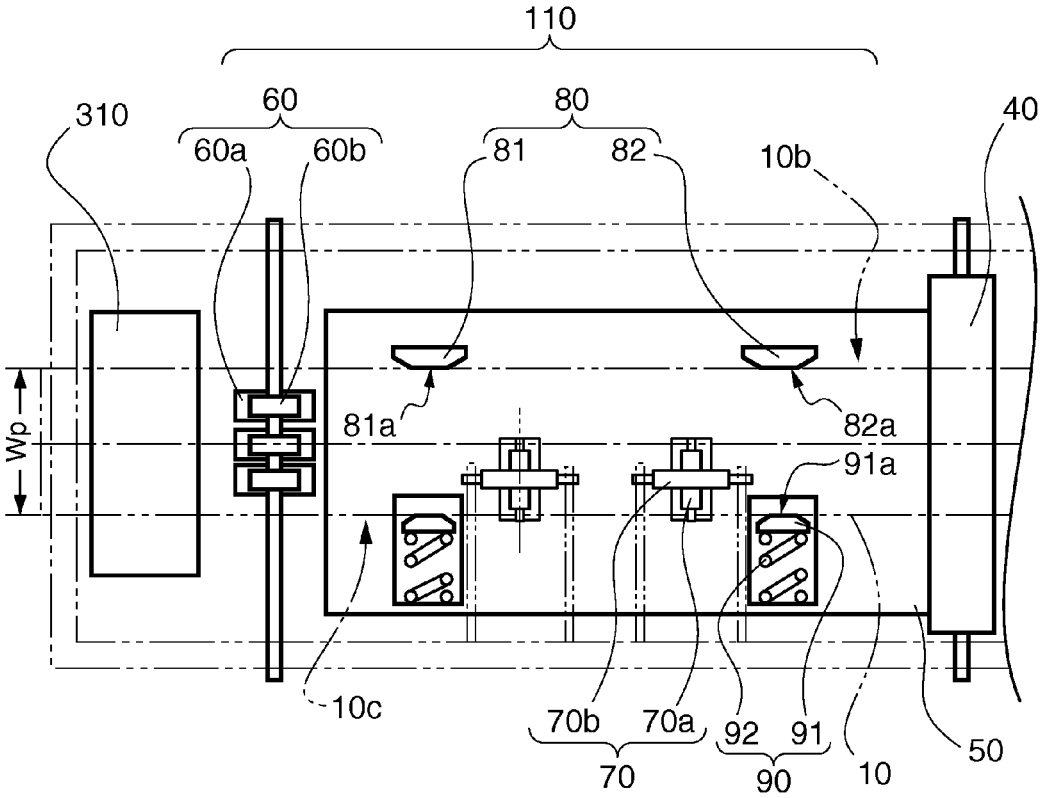
FIG. 4A is a plan view of the conveyance unit according to a second embodiment of the invention.

FIG. 4 shows a conveyance unit 110 as an example of a conveyance device according to a second embodiment of the invention. This conveyance unit 110 differs from the conveyance unit 100 of the first embodiment by using an urging unit 90 as an urging means that urges the recording paper 10 to the guide 80. Other aspects are the same as in the conveyance unit 100, identified by like reference numerals, and further description thereof is omitted.

As shown in FIG. 4, the urging unit 90 of the conveyance unit 110 according to the second embodiment of the invention has an urging end 91 with a face 91*a* that contacts the opposite edge 10*c* of the recording paper 10 as the edge 10*b* that contacts the guide 80, and a coil spring 92 as an urging member that urges the urging end 91 towards the guide 80.

Figure 4B:
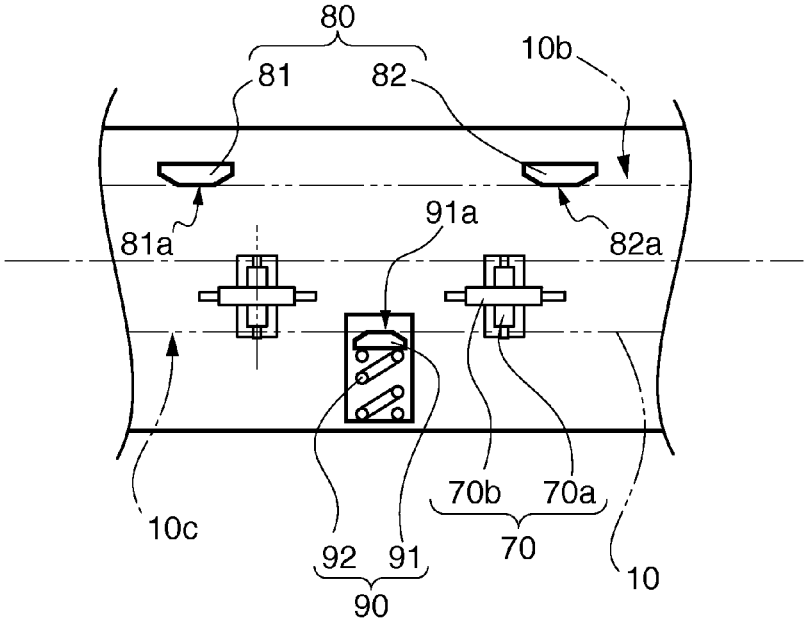
FIG. 4B is a plan view of a variation of the second embodiment.

The urging unit 90 is disposed to the recording paper support unit 50 movably relative to the width Wp of the recording paper 10 by a position adjusting means not shown, and applies a desirable urging force to the width Wp of the recording paper 10. In the conveyance direction of the recording paper 10, the urging units 90 are preferably disposed opposite the guides 80 with the recording paper 10 therebetween. Alternatively, as shown in FIG. 4B, an urging unit 90 may be disposed to a position midway between the locations of the first stop 81 and second stop 82 of the guide 80. Because the action of controlling the recording paper 10 to the desired conveyance direction can be achieved by the edge 10*b* of the recording paper 10 contacting the guide 80, the urging unit 90 is preferably disposed to a position where an urging force pushing the recording paper 10 evenly against the first stop 81 and second stop 82 can be applied.

The urging force of the urging unit 90 to the recording paper 10 is applied in addition to the urging force of the intersect rollers 70 urging the recording paper 10 to the guide 80 as described in FIG. 3. The urging force of the urging unit 90 is adjusted so that the urging force combining the urging force of the urging unit 90 to the recording paper 10 and the urging force produced by the intersect rollers 70 is less than the bending limit F0 of the recording paper 10.

Figure 5A:
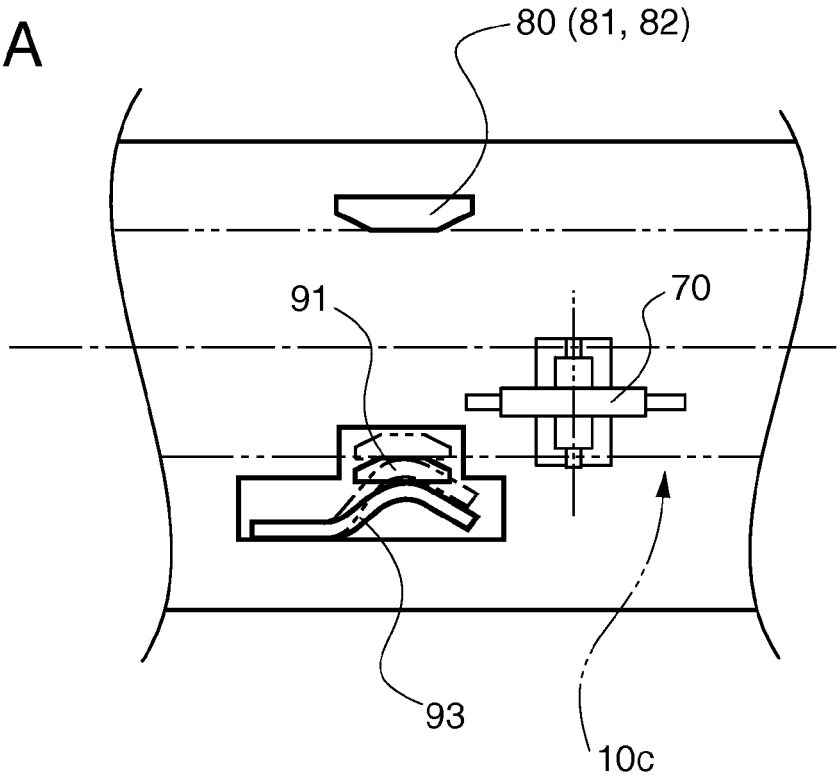
FIG. 5 shows another variation of the urging unit in the second embodiment of the invention.
Figure 5B:
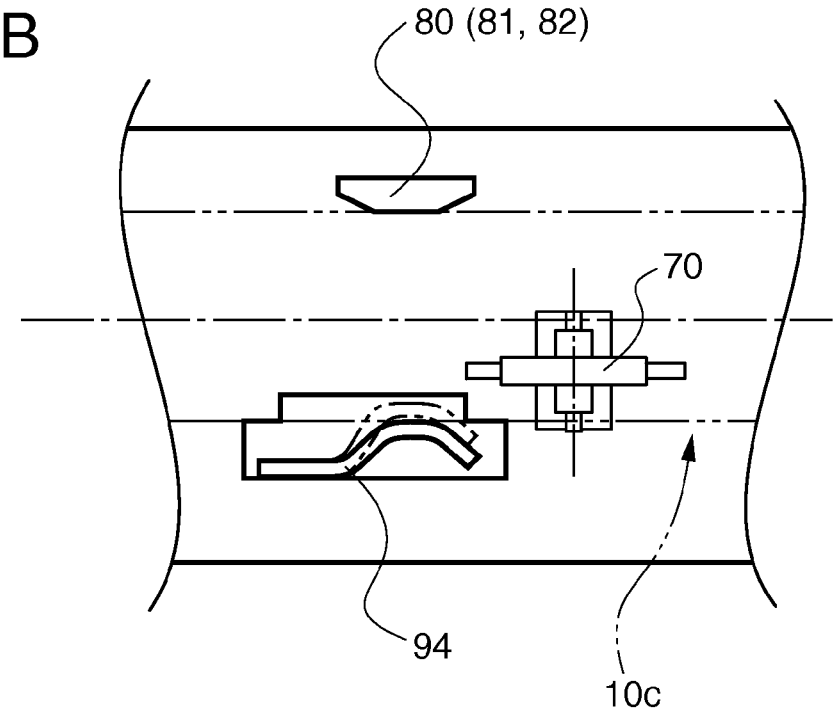

Note that a coil spring 92 is used as an elastic member in the urging unit 90 shown in FIG. 4, but the invention is not so limited. As shown in FIG. 5A, for example, a flat spring 93 that can deflect widthwise to the recording paper 10 can be used to urge the urging end 91, or a flat spring 94 that can deflect widthwise to the recording paper 10 as shown in FIG. 5B could be used to urge the recording paper 10.

The conveyance unit 110 according to the second embodiment of the invention can reliably urge the recording paper 10 to the guide 80 by the urging force of the urging unit 90 in addition to urging the recording paper 10 to the guide 80 by the action of the intersect rollers 70 as described in FIG. 3, and can thus hold the recording paper 10 in the desired conveyance direction.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No: 2011-175650, filed Aug. 11, 2011 is expressly incorporated by reference herein.

What is claimed is:

1. A printing device, comprising:

a guide roller configured to guide a print medium in a conveyance direction;

an intersect roller pair configured to hold the print medium guided by the guide roller between a first roller rotatable on an axis of rotation in the conveyance direction of the print medium and a second roller rotatable on an axis of rotation perpendicular to the axis of rotation of the first roller;

a conveyance roller pair configured to convey the print medium held by the intersect roller pair in the conveyance direction by a conveyance drive roller driven by a drive mechanism and a conveyance follower roller rotatable with the conveyance drive roller; and a print unit configured to print on the print medium conveyed by the conveyance roller pair, wherein the first roller and the second roller are disposed above one another such that the centers of each roller are disposed along the same axis, said axis being normal to the axis of rotation, wherein the printing device further comprises a guide configured to guide one edge of the print medium in the conveyance direction, wherein the conveyance roller pair is disposed substantially in a center of the print medium width perpendicular to the conveyance direction, and wherein the intersect roller pair is disposed on a side of the opposite edge of the print medium as the one edge in the conveyance direction.

2. The printing device described in claim 1, further comprising:

a second intersect roller pair configured to hold the print medium held by the intersect roller pair between a third roller rotatable on an axis of rotation in the conveyance direction of the print medium and a fourth roller rotatable on an axis of rotation that intersects the axis of rotation of the third roller.

3. The printing device described in claim 1, wherein:

the first roller has a part configured to contact the print medium and including polyacetal, and the second roller has a part configured to contact the print medium and including stainless steel.

4. The printing device described in claim 1, further comprising:

a pressure mechanism configured to push the print medium to the guide.

5. A conveyance device for a printing device, the conveyance device comprising:

an intersect roller pair configured to hold a conveyed print medium between a first roller that rotates on an axis of rotation in the conveyance direction of the print medium and a second roller configured to rotate on an axis of rotation perpendicular to the axis of rotation of the first roller; and a conveyance roller pair configured to convey the print medium held by the intersect roller pair in the conveyance direction by a conveyance drive roller driven by a drive mechanism and a conveyance follower roller configured to rotate with the conveyance drive roller, wherein the first roller and the second roller are disposed above one another such that the centers of each roller are disposed along the same axis, said axis being normal to the axis of rotation, wherein the conveyance device for a printing device further comprises a guide configured to guide one edge of the print medium in the conveyance direction, wherein the side stops are arranged in series along one side of the conveyance direction of the conveyed print medium, wherein the urging unit is configured to apply a force to the conveyed print medium in a direction toward the side stops, and wherein the force applied by the urging unit is such that the conveyed print medium contacts at least two consecutive side stops substantially evenly.

6. The conveyance device for a printing device described in claim 5, wherein:

the conveyance roller pair is disposed substantially in a center of the print medium width perpendicular to the conveyance direction; and the intersect roller pair is disposed on a side of the opposite edge of the print medium as the one edge in the conveyance direction.

7. The printing device of claim 1, further comprising a suction unit configured to apply suction to the print medium in order to hold the print medium for printing.

8. The printing device of claim 1, wherein the print medium is roll paper.

9. The printing device of claim 1, further comprising an urging unit and a plurality of side stops, wherein:

the side stops are arranged in series along one side of the conveyance direction of the print medium, the urging unit is configured to apply a force to the print medium in a direction toward the side stops, and the force applied by the urging unit is such that the print medium contacts at least two consecutive side stops substantially evenly.

10. The conveyance device for a printing device described in claim 5, further comprising a suction unit configured to apply suction to the conveyed print medium in order to hold the medium for printing.

11. The conveyance device for a printing device described in claim 5, wherein the conveyed print medium is roll paper.

12. A printing device, comprising:

a guide roller configured to guide a print medium in a conveyance direction;

an intersect roller pair configured to hold the print medium guided by the guide roller between a first roller rotatable on an axis of rotation in the conveyance direction of the print medium and a second roller rotatable on an axis of rotation perpendicular to the axis of rotation of the first roller;

a conveyance roller pair configured to convey the print medium held by the intersect roller pair in the conveyance direction by a conveyance drive roller driven by a drive mechanism and a conveyance follower roller rotatable with the conveyance drive roller;

a print unit configured to print on the print medium conveyed by the conveyance roller pair; and at least two urging units and at least two side stops, wherein respective urging units are located directly across from respective side stops in a direction normal to the conveyance direction.

13. The printing device described in claim 12, wherein:

the first roller has a part configured to contact the print medium and including polyacetal, and the second roller has a part configured to contact the print medium and including stainless steel.

14. The printing device described in claim 12, further comprising:

a pressure mechanism configured to push the print medium to the guide.

15. The printing device of claim 12, further comprising a suction unit configured to apply suction to the print medium in order to hold the print medium for printing.

16. The printing device of claim 12, wherein:

the side stops are arranged in series along one side of the conveyance direction of the print medium, the urging are configured to apply a force to the print medium in a direction toward the side stops, and the force applied by the urging units is such that the print medium contacts at least two consecutive side stops of the at least two side stops substantially evenly.

* * * * *